United States Patent [19]

Daar et al.

[11] Patent Number: 4,521,228

[45] Date of Patent: Jun. 4, 1985

[54] CONTROL DEVICE FOR AN ELECTROSTATIC PRECIPITATOR

[75] Inventors: Horst Daar, Erlangen; Franz Alig, Johannesberg, both of Fed. Rep. of Germany

[73] Assignees: Siemens Aktiengesellschaft, Munich; Metallgesellschaft Aktiengesellschaft, Frankfurt am Main, both of Fed. Rep. of Germany

[21] Appl. No.: 628,777

[22] Filed: Jul. 9, 1984

[30] Foreign Application Priority Data

Jul. 20, 1983 [DE] Fed. Rep. of Germany ..... 3326041

[51] Int. Cl.[3] ..... B03C 3/68

[52] U.S. Cl. ..... 55/105; 323/903

[58] Field of Search ..... 55/105, 139, 4; 323/903

[56] References Cited

U.S. PATENT DOCUMENTS

| | | | |
|---|---|---|---|
| 3,893,828 | 7/1975 | Archer | 55/112 X |
| 4,209,306 | 6/1980 | Feldman et al. | 55/2 |
| 4,284,417 | 8/1981 | Reese et al. | 55/2 |
| 4,432,061 | 2/1984 | Herklotz et al. | 55/105 X |

FOREIGN PATENT DOCUMENTS

| | | | |
|---|---|---|---|
| 30321 | 6/1981 | European Pat. Off. | 55/105 |
| 0035209 | 9/1981 | European Pat. Off. . | |
| 2949797 | 6/1981 | Fed. Rep. of Germany . | |
| 3048979 | 10/1982 | Fed. Rep. of Germany | 55/105 |
| W083/01746 | 5/1983 | PCT Int'l Appl. | 55/4 |
| 2110431 | 6/1983 | United Kingdom . | |

*Primary Examiner*—Kathleen J. Prunner
*Attorney, Agent, or Firm*—Kenyon & Kenyon

[57] ABSTRACT

A control device for an electrostatic precipitator including a plurality of filter chambers connected in series to one another comprises a first component connected to a particle density sensor at the output of the last filter chamber for computing desired values of the particle densities at the outlets of the individual filter chambers in response to the difference between a desired particle density and a measured particle density of the outflowing gases at the output of the last filter chamber. The control device includes a second component for estimating actual values of the particle densities at the outlets of the individual filter chambers and a third component connected to the first and the second component for generating control signals in response to the deviation between the computed desired particle densities and the estimated actual particle densities, the control signals being fed to individual filter control units operatively coupled to transformer and rectifier sets associated with respective filter chambers.

4 Claims, 2 Drawing Figures

CONTROL DEVICE FOR AN ELECTROSTATIC PRECIPITATOR

BACKGROUND OF THE INVENTION

This invention relates to a control device for an electrostatic precipitator having several filter chambers connected in series to one another.

Many industries such as the cement industry produce as by-products dust laden effluent gases which have to be cleaned before they are discharged to the atmosphere. Sometimes it is desirable to recover the dust also because of the inherent commercial value thereof. Electrostatic precipitators have been found to be a particularly cost-effective means of removing particles from effluent gases.

An electrostatic precipitator essentially comprises at least one electrical discharge electrode energizable to a high negative potential and at least one collector surface which is grounded. The gas to be cleaned flows between the discharge electrode and the collector surface. An electrical corona discharge from the discharge electrode causes the dust particles in the gas stream to acquire negative electrical charges while the electrostatic field causes the negatively charged particles to move towards and to be collected upon the grounded collector surface. The agglomerated dust particles are periodically removed from the collector surface by means of a recurrent rapping of the collector surface.

The discharge electrodes are usually wires or spiked rods maintained at the required negative potential by means of an electrical transformer and rectifier set.

Where a plurality of filter chambers are connected in series to one another, each filter chamber may be provided with an associated control element including an electrical transformer and rectifier set for generating between the electrodes of each filter chamber electrostatic fields for the collection of dust particles from a stream of air flowing from one filter chamber to the next in the interconnected series.

As described in European Patent Application No. 35,209, a pilot computer may be provided for modifying control variables as a function of the difference between a desired particle density of the outflowing gases at the output of the series of filter chambers and the actual particle density of the gases at the precipitator output, the control variables being fed in the form of electrical signals to the filter control of each filter chamber. A microcomputer system connected to the pilot computer via a coupling member and a data bus is associated with each filter or filter chamber for controlling the operation thereof. The pilot computer is programmed for calculating optimal electrical field strength in the individual filter chambers.

As set forth in German Patent Document (Deutsche Offenlegungsschrift) No. 29 49 797, the particle density of the gas at the output of a precipitator is detected by a particle density measuring device or sensor. The electrodes of a plurality of filter chambers in the precipitator are energized in such a matter as to attain the desired degree of separation with a minimum consumption of energy.

An object of the present invention is to provide an improved control device for an electrostatic precipitator.

Another object of the present invention is to provide such a control device with a pilot computer of improved design such that the particle density of the effluent gases at the output of the precipitator are brought as closely as possible in alignment with a preset reference value.

Yet another object of the present invention is to provide such a control device with a pilot computer which is adaptable to essentially all modes of operation existing in practice.

SUMMARY OF THE INVENTION

An electrostatic precipitator has a plurality of filter chambers connected in series to one another, the effluent gases at the output of each of said chambers having a respective particles density. The plurality of filter chambers includes an input chamber and an output chamber downstream thereof. In accordance with the invention, a device for controlling the operation of the electrostatic precipitator comprises field generating circuitry, current regulating circuitry, a particle density sensor, and control means.

The field generating circuitry is operatively linked to the filter chambers for generating therein electrostatic fields for the collection of dust particles from a stream of air flowing through the chambers. The current regulating circuitry is operatively coupled to the field generating circuitry for controlling the flow of electrical current thereto and thereby partially determining the electrical field density of the electrostatic fields in the filter chambers. The particle density sensor is disposed at the outlet of the output chamber for monitoring the dust content of outflowing gas of the precipitator. The control circuitry is operatively linked to the current regulating circuitry for supplying thereto control signals determinative of the amount of current to be fed to the field generating circuitry.

The control circuitry includes a first computing circuit operatively tied to the particle density sensor for generating from the loop gains of the filter chambers and from the difference between a desired particle density of the outflowing gas and an actual particle density thereof detected by the particle density sensor electrical signals coding control variable which represent at least in part the desired particle densities at the outlets of the individual filter chambers. The control circuitry further includes an estimating circuit for forming estimated actual particle densities of effluent gases at the outputs of the individual filter chambers. A second computing circuit in the control circuitry is operatively connected to the estimating circuit, the first computing circuit and the current regulating circuitry for generating the control signals at least partially in response to the differences between desired particle densities calculated by the first computing circuit and respective actual particle densities estimated by the estimating circuit.

In accordance with another feature of the present invention, the estimating circuit is operatively coupled to the particle density sensor. The estimating circuit compares a measured actual particle density of the outflowing gas at the output of the precipitator with an estimated particle density of the outflowing gas. In response to the comparison the estimating circuit modifies the estimated actual particle densities of the effluent gases at the outputs of the individual filter chambers.

In accordance with another feature of the present invention, the estimating circuit generates the estimated actual particle densities by means of a model of the electrostatic precipitator. The model comprises a plurality of parameters, the estimating circuit functioning to modify the parameters in response to the comparison of the measured actual particle density of the outflowing gas with the estimated particle density thereof.

In accordance with yet another feature of the present invention, a third computing circuit is included in the control circuitry for optimizing energy utilization by the precipitator. The third computing circuit is coupled to the first and the second computing circuits and functions to vary the electrical signals coding the control variables which represent at least in part desired particle densities at the outlets of the individual filter chambers.

DETAILED DESCRIPTION

Figure 1:
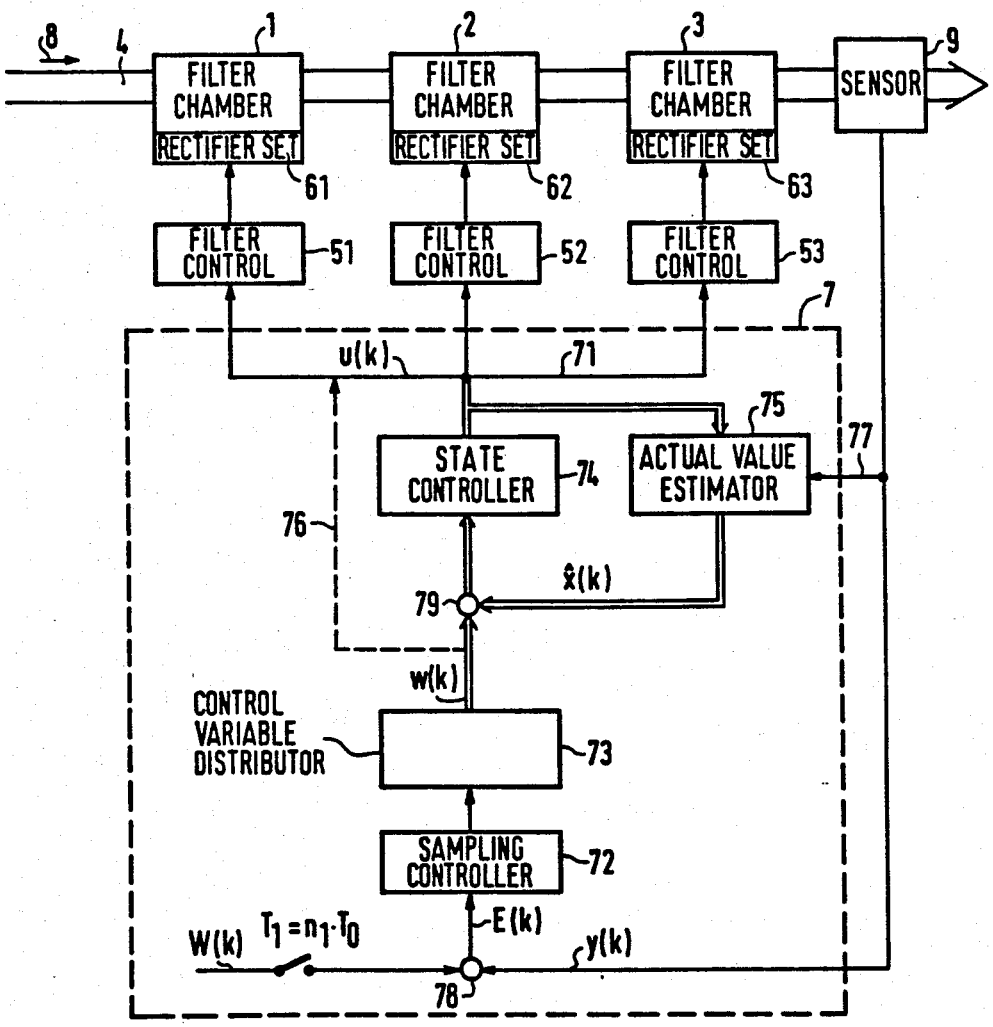
FIG. 1 is a block diagram of an electrostatic precipitator and a control device operatively connected thereto.

As illustrated in FIG. 1, an electrostatic precipitator comprises three filter chambers 1, 2 and 3 connected in series with one another for purifying a stream of particle laden air for passing through the filter chambers in the direction indicated by an arrow 8. Associated with each filter chamber is a respective transformer and rectifier set 61, 62 and 63 each of which in turn is electrically connected to a respective control circuit 51, 52 and 53. Control circuits 51, 52 and 53 may take the form of microprocessors as described in German Patent Document No. 29 49 797.

The transport time $T_0$ of gas or air 4 from one filter chamber to the next is defined by the quotient $V/\dot{V}$, where V is the volume in cubic meters of a filter chamber and $\dot{V}$ is the volume metric flow of the gas in cubic meters per second. Transformer and rectifier sets 61, 62 and 63 are operatively coupled to electrodes in the filter chambers for generating between the electrodes electrostatic fields for the collection of dust particles from the stream of air 4 flowing through the chambers. Filter controls 51, 52 and 53 constitute current regulators operatively coupled to the transformer and rectifier sets 61, 62 and 63 for controlling the flow of electrical current thereto and thereby partially determining the electric field density of the electrostatic fields generated in the filter chambers. The filter controls are connected by means of a bus system 71 to a pilot computer 7 which is in turn connected at a pair of inputs to a particle density measuring device or sensor 9 such as an optical transducer disposed at the outlet of the output chamber 3 for monitoring the dust content of the gas leaving the precipitator.

In response to control signals u(k) (k=1, 2 or 3) representing filter current reference values for the individual filter chambers of the precipitator, the filter controls 51, 52 and 53 vary the amount of electrical current flowing to transformer and rectifier sets 61, 62 and 63, thereby modifying the electric fields in the filter chambers and the extent to which dust is separated out from the flowing air stream. Control signals u(k) are transmitted to the individual filter controls 51, 52 and 53 via bus system 71.

Pilot computer 7 comprises a sampling controller 72 (PI) connected at an input to an adder 78 for receiving therefrom a signal E(k) representative of the difference between a desired particle density W(k) and a measured actual particle density y(k) of the outflowing gas at the output of the precipitator. Adder 78 is connected via a lead 77 to particle density sensor 9 for receiving therefrom an electrical signal coding the dust content of the output gas. Adder 78 receives at another input from a nonillustrated storage device or input port an electrical signal coding the desired particle density W(k) of the gases at the output of the precipitator. Sampling controller 72 performs a comparison of the desired ultimate particle density and the actual final particle density at a periodic interval substantially equal to transport time $T_0$, i.e., sampling occurs at times $T_1 = n_1 \cdot T_0$ where the multiplier $n_1$ represents an integer greater than 0.

Sampling controller 72 is connected at an output to a control variable distributor 73 which operates in accordance with a previously known control variable model to calculate, in response to the comparison results from sampling controller 72, control variables or filter current reference values w(k) which may, for example, represent at least in part desired particle densities of effluent gases at the outlets of the individual filter chambers.

Control variables w(k) could be fed directly in the form of electrical signals to filter control units 51, 52 and 53, as indicated by dash line 76. In this case, control variables w(k) can be changed in equal amounts upon the detection of a difference between the desired ultimate particle density and the actual particle density of the gases at the output of the precipitator.

As illustrated in FIG. 1, control variable distributor 73 is connected at an output to a first input of an adder 79 which receives at a second input estimated actual particle densities $\hat{x}(k)$ of the effluent gases at the outlets of the individual filter chambers. These estimated actual particle densities are calculated by an actual value estimator or adaptive observer 75.

Adder 79 works into a state controller 74 connected at an output to system bus 71 and actual value estimator 75 for delivering thereto control signals u(k).

State controller 74 essentially functions to compare the desired particle densities of the effluent gases at the outlets of the individual filter chambers, as calculated by sampling controller 72 and control variable distributor 73, with corresponding estimated actual particle densities computed by actual value estimator 75. In response to the comparison process, the state controller 74 derives the control signals u(k) for individual filter controls 51, 52 and 53. The double lines in FIG. 1 indicate that the computing processes are carried out successively for the individual filter chambers 1, 2 and 3. The computation of desired particle densities by sampling controller 72 and control variables distributor 73 and the computation of control signals u(k) by state controller 74 in response to the desired particle densities and to the estimated actual particle densities computed by actual value estimator 75 represent a two-stage control strategy resulting in an increased accuracy of the precipitator control process.

Control variables or desired particle densities w(k) for the individual filter chambers 1, 2 and 3 may be computed by control variable distributor 73 by, for example, multiplying difference signal E(k) by a weighting factor and adding the resulting product to the preceding value for the respective chamber 1, 2 or 3, where the weighting factor depends on the loop gain, i.e., the purifying power, of the respective filter chamber.

Actual value estimator 75 computes the estimated actual particle densities of the effluent gases at the outlets of the individual filter chambers 1, 2 and 3 in accordance with a model of the separation process occurring within the filter chambers. One such model is based upon the equation:

$$C_A = C_E e^{-IF/Vq},$$

where parameter $C_E$ represents the particle density of concentration of the incoming gases at the inlet of the precipitator, parameter $C_A$ represents the particle density or concentration of the outflowing gases at the output of the precipitator, parameter $I_f$ represents the filter current in amperes and parameter q represents the specific space charge in Coulombs per cubic meter, the particle densities being measured, for example, in milligrams per cubic meter. From this equation the estimated actual particle density of the effluent gases at the outlet of each filter chamber 1, 2 and 3 can be computed. It is to be noted that the particle density of the gases at the output of one filter chamber equals the particle density of the input gases of the following filter chamber.

Actual value estimator 75 is connected at an input to particle density sensor 9 via lead 77 for receiving therefrom, preferably at periodic intervals, the measured actual particle density of the outflowing gases at the outlet of the precipitator. In response to the measured actual particle density, actual value estimator 75 modifies parameters which define the model of the precipitation process in the filter chambers and thereby modifies the estimated actual particle densities of the effluent gases of the individual filter chambers.

Computer 7 may be provided with means for dividing up or distributing a change in the overall degree of dust particle precipitation among the plurality of filter chambers 1, 2 and 3 so that the change is made at that point at which the change has the greatest affect in view of the overall purification. This distribution may be effected, for example, in accordance with the equation set forth above by determining the expected particle density change per filter chamber as a function of the change in filter current.

Figure 2:
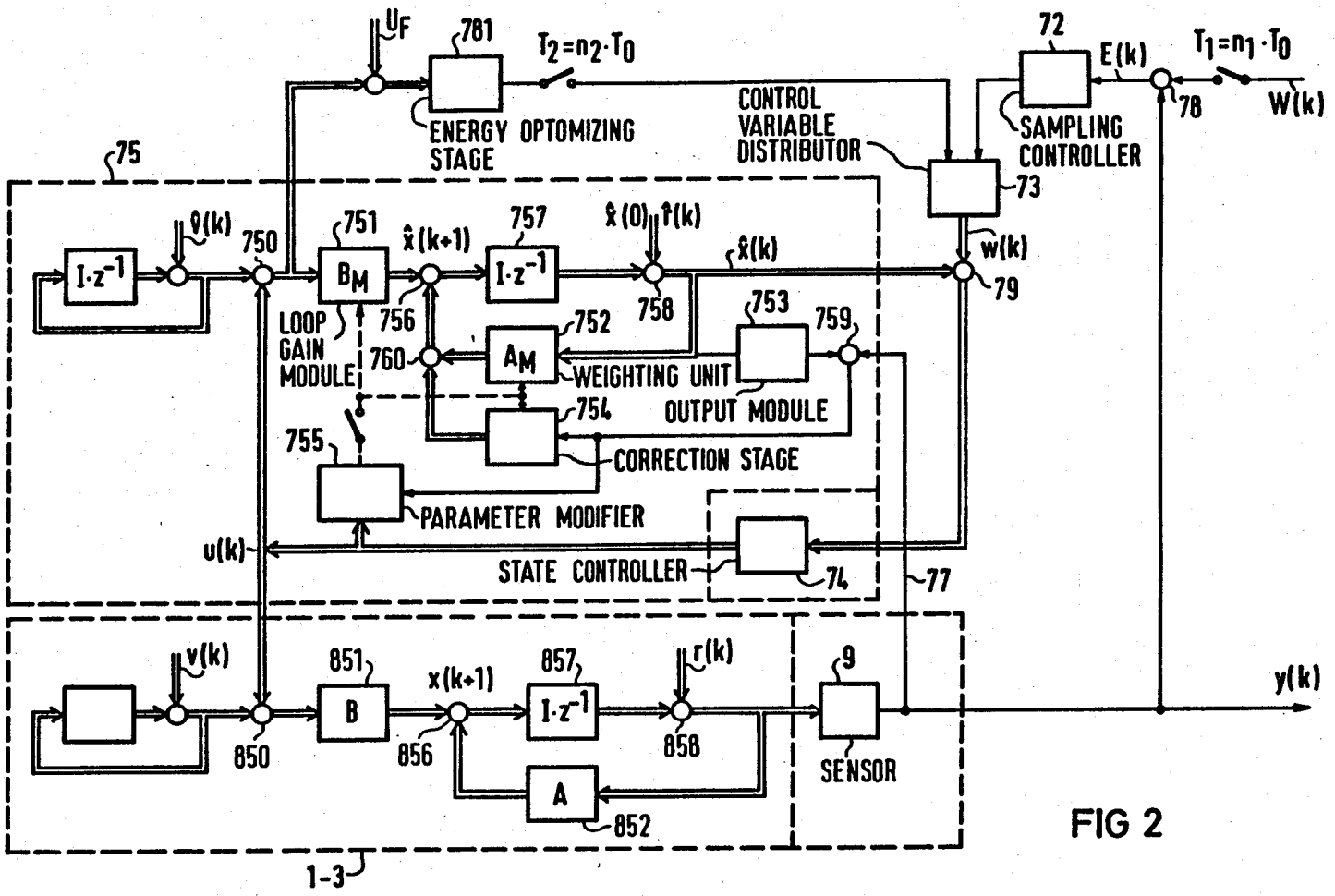
FIG. 2 is partially a block diagram and partially a diagrammatic representation of the processes occurring in the precipitator and control device of FIG. 1.

As indicated in FIG. 2, the desired final particle density and the measured actual final particle density are compared with one another by the main controller 72 at cyclic intervals. The output signal of sampling controller 72 is fed to control variable distributor 73 for conversion thereby into control variables w(k) representing, for example, desired output particle densities for the individual filter chambers 1, 2 and 3. From control variables w(k) are subtracted respective estimated actual particle densities $\hat{x}(k)$ computed by actual value estimator 75, the subtraction being executed by adder 79. In response to the differences between control variables w(k) and the estimated actual values $\hat{x}(k)$, state controller 74 forms control variables u(k) which are fed in the form of electrical signals to filter controls 51, 52 and 53 for varying the amount of electrical current supplied to transformer and rectifier sets 61, 62 and 63.

The computations undertaken by actual value estimator 75 preferably take into account the electrical input currents of the transformer and rectifier sets 61, 62 and 63, disturbances in the air flow at the air input of the precipitator and physical limitations on the operation of the precipitator. In the diagram of FIG. 2 the effects of input currents, physical limitations and breakdowns on the operation of the filter chambers are quantified by a parameter $\hat{v}(k)$, while the effects of air flow disturbances are codified by disturbance variables $\hat{r}(k)$.

As illustrated in FIG. 2, the control signals containing in coded form control variables u(k) are transmitted from state controller 74 to an adder 750 wherein control variables u(k) are algebraically combined with a parameter $\hat{v}(k)$. The resulting algebraic combination is supplied to a loop gain module 751 which weights the sum from adder 750 with weighting factors $B_M$ indicative of the efficiency of the individual filter chambers. Loop gain module 751 is connected to a second adder 756 which combines the weighted sum from loop gain module 751 with the output value of the preceding filter chamber, which value has been weighted by a factor $A_M$ in a multiplication element 752. The resulting sum $\hat{x}(k+1)$ represents, upon further mathematical manipulation in a unit 757 in accordance with the equation set forth above, a first estimated actual particle density at the output of the respective filter chamber. An adder 758 algebraically combines this first estimated actual particle density with a parameter $\hat{r}(k)$ coding the effects of such disturbances as air turbulence. A corrected value $\hat{x}(k)$ for the estimated actual particle density at the output of the respective filter chamber is transmitted by adder 758 to weighting unit or multiplier 752 and to adder 79. As heretofore described, adder 79 forms the difference between a desired particle density w(k) for an individual filter chamber and the estimated actual particle density of the effluent gases at the output of the same filter chamber.

The estimated actual particle density of the effluent gases at the output of the third filter chamber 3 is fed to an output module 753 and an adder 759 for comparison with the measured actual particle density of the outflowing gas at the output of filter chamber 3, as detected by particle density sensor 9. The deviation between the estimated actual particle density and the measured actual particle density is fed from adder 759 to a correction stage 754 and to a parameter modifier 755. Correction stage 754 is connected to adder 756 via another adder 760 at the output of multiplier 752 for implementing a correction in the estimated actual particle density in response to the deviation between the estimated actual particle density and the measured actual particle density of the effluent gases at the output of filter chamber 3. Parameter modifier module 755 serves to update or correct system parameters $A_M$ and $B_M$ in response to the deviation signal from output module 753 and adder 759, parameter $B_M$ representing the loop gain of an individual filter chamber as taken into account by loop gain module 751.

The operations performed by the components of actual value estimator 75 correspond to physical processes occurring within the individual filter chambers, as indicated by blocks 850–852 and 856–858 in FIG. 2.

The sums formed by adder 750 are fed, together with filter voltages, to an energy-optimizing stage 781 connected at an output to control variable distributor 73 and acting on the formation of the control variables w(k) at an interval $T_2$ which is a multiple of transport time $T_0$.

Although the invention has been described in terms of specific embodiments and applications a person skilled in the art, in light of this teaching, can produce additional embodiments without departing from the spirit of or exceeding the scope of the claimed invention. Accordingly, it is to be understood that the drawings and description in this disclosure are preferred to facilitate comprehension of the invention and should not be construed to limit the scope thereof.

What is claimed is:

1. A device for controlling an electrostatic precipitator having a plurality of filter chambers connected in series to one another, effluent gases at the outputs of each of said chambers having a respective dust density, said plurality of chambers including an input chamber and an output chamber downstream thereof, said device comprising:

field generating means operatively linked to the filter chambers for generating therein electrostatic fields for the collection of dust particles from a stream of air flowing through said chambers;

current regulating means operatively coupled to said field generating means for controlling the flow of electrical current thereto and thereby partially determining the electric field density of the electrostatic fields in said chambers;

sensing means at the outlet of said output chamber for monitoring the dust content of outflowing gas of the precipitator; and control means operatively linked to said current regulating means for supplying thereto control signals determinative of the amount of current to be fed to said field generating means, said control means including first computing means operatively tied to said sensing means for generating from the loop gains of said chambers and from the difference between a desired particle density of said outflowing gas and an actual particle density thereof detected by said sensing means electrical signals coding control variables representing at least in part desired particle densities at the outlets of said chambers, said control means further including estimating means for forming estimated actual particle densities of effluent gases at the outputs of said chambers, said control means further including second computing means operatively connected to said estimating means, said first computing means and said current regulating means for generating said control signals at least partially in response to the differences between desired particle densities calculated by said first computing means and respective estimated actual particle densities formed by said estimating means.

2. The device defined in claim 1 wherein said estimating means is operatively coupled to said sensing means for comparing a measured actual particle density of said outflowing gas with an estimated particle density thereof and modifying said estimated actual particle densities in response to said comparison.

3. The device defined in claim 2 wherein said estimating means generates said estimated actual particle densities by means of a model of the electrostatic precipitator, said model comprising a plurality of parameters, said estimating means functioning to modify said parameters in response to said comparison.

4. The device defined in claim 3, further comprising third computing means operatively coupled to said first and said second computing means for varying said electrical signals to optimize energy utilization by the precipitator.

* * * * *